US008887607B2

(12) United States Patent
Cavagna

(10) Patent No.: US 8,887,607 B2
(45) Date of Patent: Nov. 18, 2014

(54) TOOL CHANGE DEVICE FOR WORKING APPARATUS OF SHEARING MACHINES

(75) Inventor: Attilio Cavagna, Galgagnano (IT)

(73) Assignee: Elio CAVAGNA S.r.l., Galgagnano (LO) (IT)

( * ) Notice: Subject to any disclaimer, the term of this patent is extended or adjusted under 35 U.S.C. 154(b) by 629 days.

(21) Appl. No.: 13/065,981

(22) Filed: Apr. 4, 2011

(65) Prior Publication Data

US 2012/0100975 A1 Apr. 26, 2012

(30) Foreign Application Priority Data

Oct. 21, 2010 (IT) ..... MI2010A1931

(51) Int. Cl.
*B26D 1/24* (2006.01)
*B26D 7/26* (2006.01)

(52) U.S. Cl.
CPC ..... *B26D 7/2621* (2013.01); *B26D 1/245* (2013.01)
USPC ..... 83/482; 83/500; 83/698.41

(58) Field of Classification Search
USPC ..... 83/481, 482, 498, 500, 502, 503, 504, 83/506, 508.2, 508.3, 425.4, 698.41
See application file for complete search history.

(56) References Cited

U.S. PATENT DOCUMENTS

| | | | | |
|---|---|---|---|---|
| 5,370,026 | A * | 12/1994 | Cavagna | 83/500 |
| 6,732,625 | B1 * | 5/2004 | Boynton et al. | 83/482 |
| 7,509,901 | B2 * | 3/2009 | Zannini | 83/481 |
| 2001/0042425 | A1 * | 11/2001 | Belmann et al. | 83/508.1 |
| 2008/0236354 | A1 * | 10/2008 | Esposito | 83/502 |

* cited by examiner

*Primary Examiner* — Stephen Choi
(74) *Attorney, Agent, or Firm* — Collard & Roe, P.C.

(57) ABSTRACT

A tool change device (12) for working apparatus (10) of longitudinal shearing machines adapted for working on paper, cardboard, plastic films, various coupled materials, aluminum, fabric, non woven, glass fiber, carbon fiber and similar materials, wherein mechanical elements are provided for quick coupling/centering and extraction with translatory movement between a tool or blade holder head (16) and a tool holder (28) and with provision for a direct and quick feed of compressed air.

6 Claims, 3 Drawing Sheets

TOOL CHANGE DEVICE FOR WORKING APPARATUS OF SHEARING MACHINES

Figure 1:
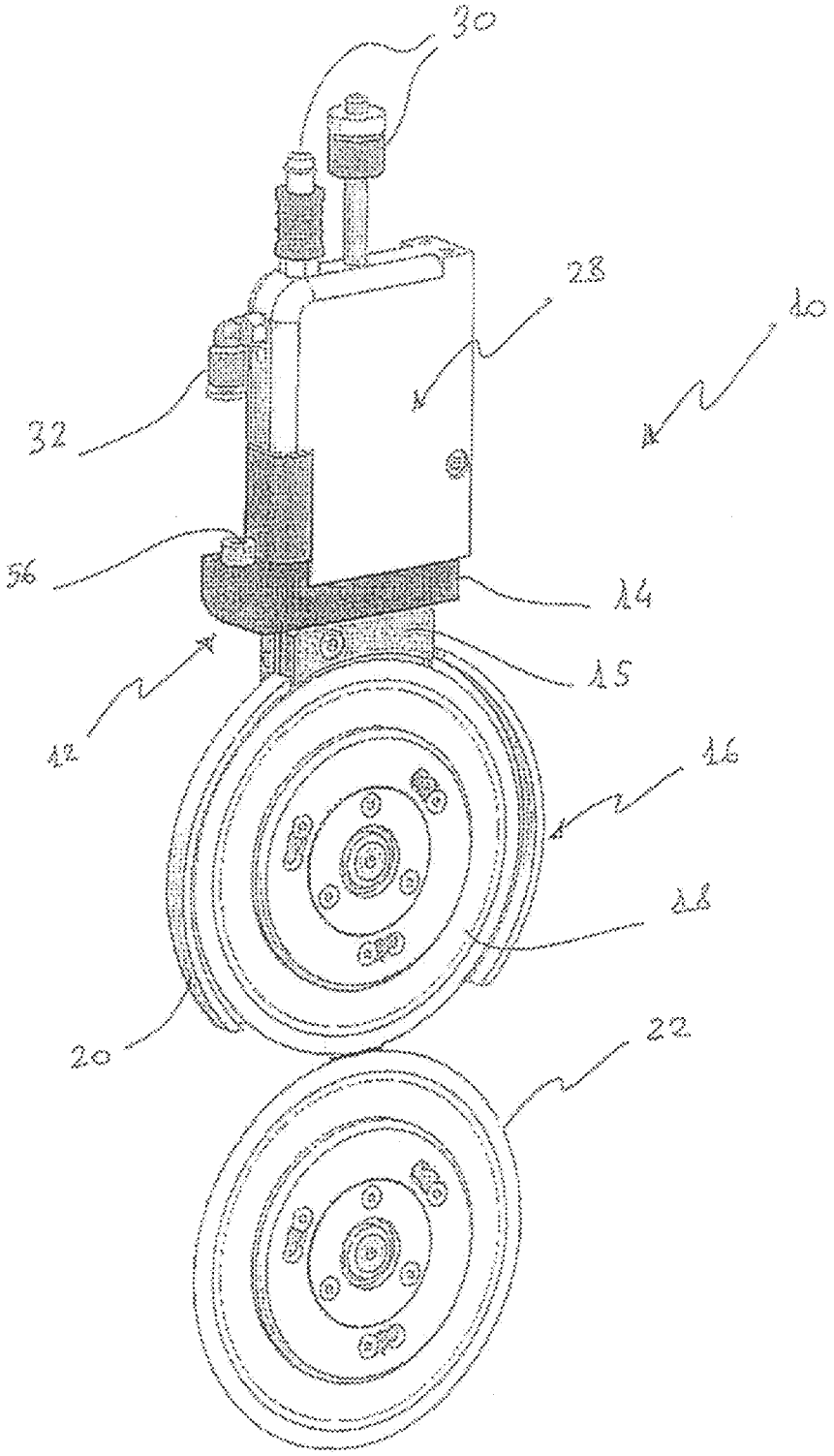

This invention relates to a tool change device for working apparatus of shearing machines. More in particular, the present invention relates to a tool change device for working apparatus of shearing machines especially of the longitudinal type, apt to work on paper, cardboard, plastic films, various coupled materials, aluminium, fabric, non woven, glass fibre, carbon fibre and similar.

As is known, the shearing machines called "longitudinal" perform the shearing of the material employing multiple and diverse techniques such as, for example, the "scissor", pressure or blade shearing; the different shearing techniques are selected in function of the thickness of the material to be sheared and of the speed of execution of the shearing operation and, therefore, in function of the production needs.

To perform the shearing operation, said machines employ cutting tools named "knives", defined by circular blades or by single cutting elements mounted on circular discs turnably stabilized respect to a tool holder or blade holder comprising the devices and the means apt to allow the translation of the blade or cutting element during the shearing operative phases.

The variation of the type of material to be sheared and/or the different production needs, require the change of the cuffing tool which is performed through the detachment of the tool thereof respect to the tool holder.

In some traditional shearing machines, the tool change operation is performed through a rotation of the tool thereof after releasing and partially extracting it with translatory movement; the same movements shall also be performed for the insertion of the new cutting tool.

However, said tool change procedure implies some considerable drawbacks related to the need to perform rotation movements respect to a horizontal plane in order to correctly centre the tool respect to the tool holder; a non correct centring implies consequent shearing errors and therefore a low quality final product.

A further drawback of said tool change procedure consists in the complexity of tool change resulting in not quick change times with the consequent increases in production costs.

In other types of shearing machines the tool change respect to the tool holder is performed through the release of a lever forming also the guiding element for the tool thereof.

In this case as well the drawback connected to the complex, as well as not quick tool change and the consequent production costs can be found.

A further drawback of the traditional tool change devices consists in the management of the compressed air required for the upwards and downwards movement of the tool respect to the product to be processed; the devices thereof, in fact, according to embodiment cited hereinbefore, require complex paths for the air characterised by a high level of construction accuracy and, thence, very expensive.

The object of the invention is to obviate the drawbacks discussed hereinabove.

More in particular, the object of the invention is to provide a tool change device for working apparatus of shearing machines that allows an easy as well as quick tool change not affected by centring and positioning errors.

A further object of this invention is to provide a tool change device apt to allow a simple and easy management of compressed air for the movement of the shearing components;

this with the purpose of allowing a quick connection of the components apt to allow the feed of compressed air to the cutting tool.

A further object of the present invention is to provide a tool change device for working apparatus of shearing machines suitable for ensuring a high level of resistance and reliability over time and moreover, such as to be easily and inexpensively constructed.

These and other objects are achieved by the tool change device for working apparatus of shearing machines of the present invention, which comprises mechanical means for a quick coupling/centring and extraction and with translatory movement between a tool or blade holder head and a tool holder and means for a direct and quick feed of compressed air.

Figure 2:
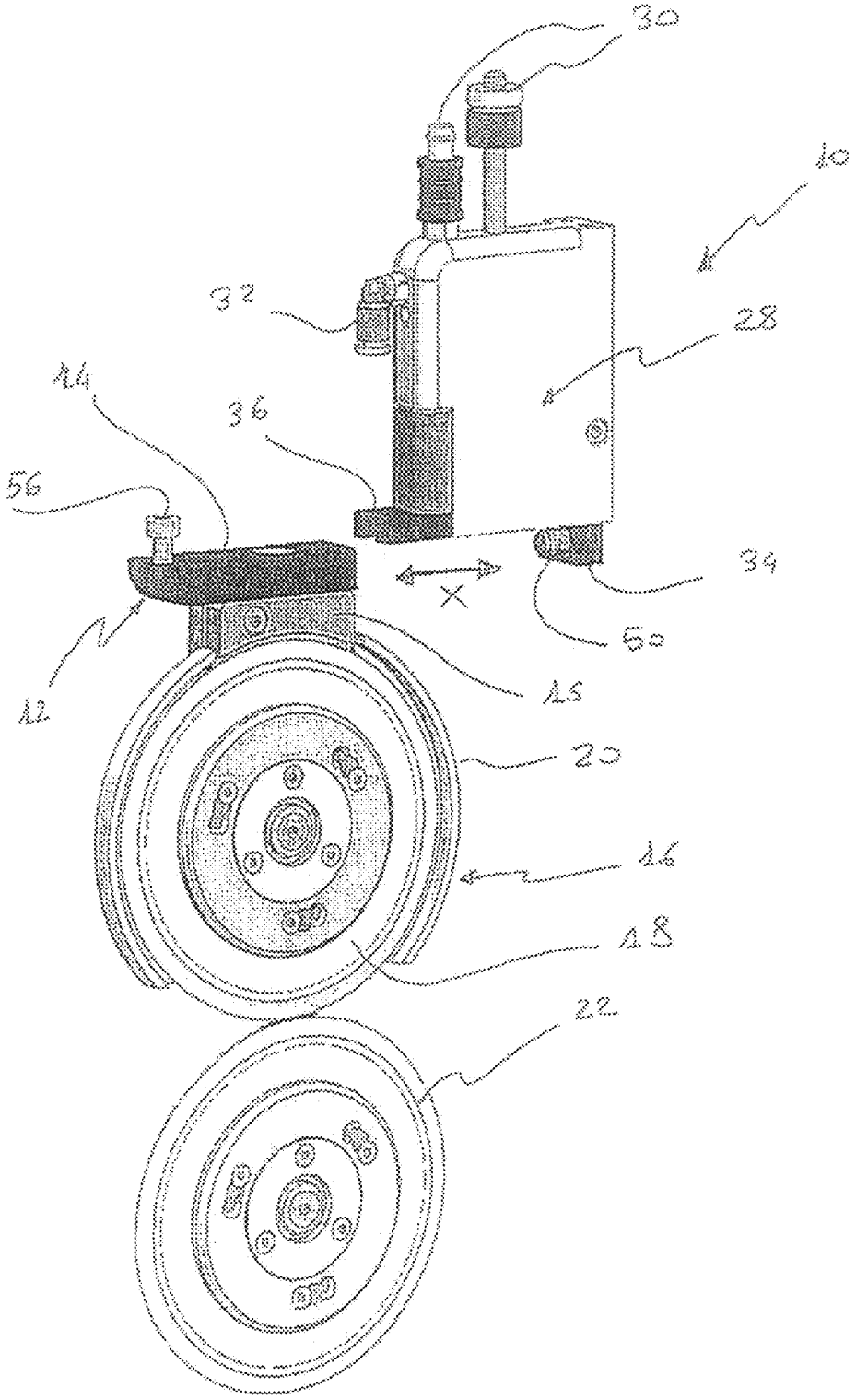
Figure 3:
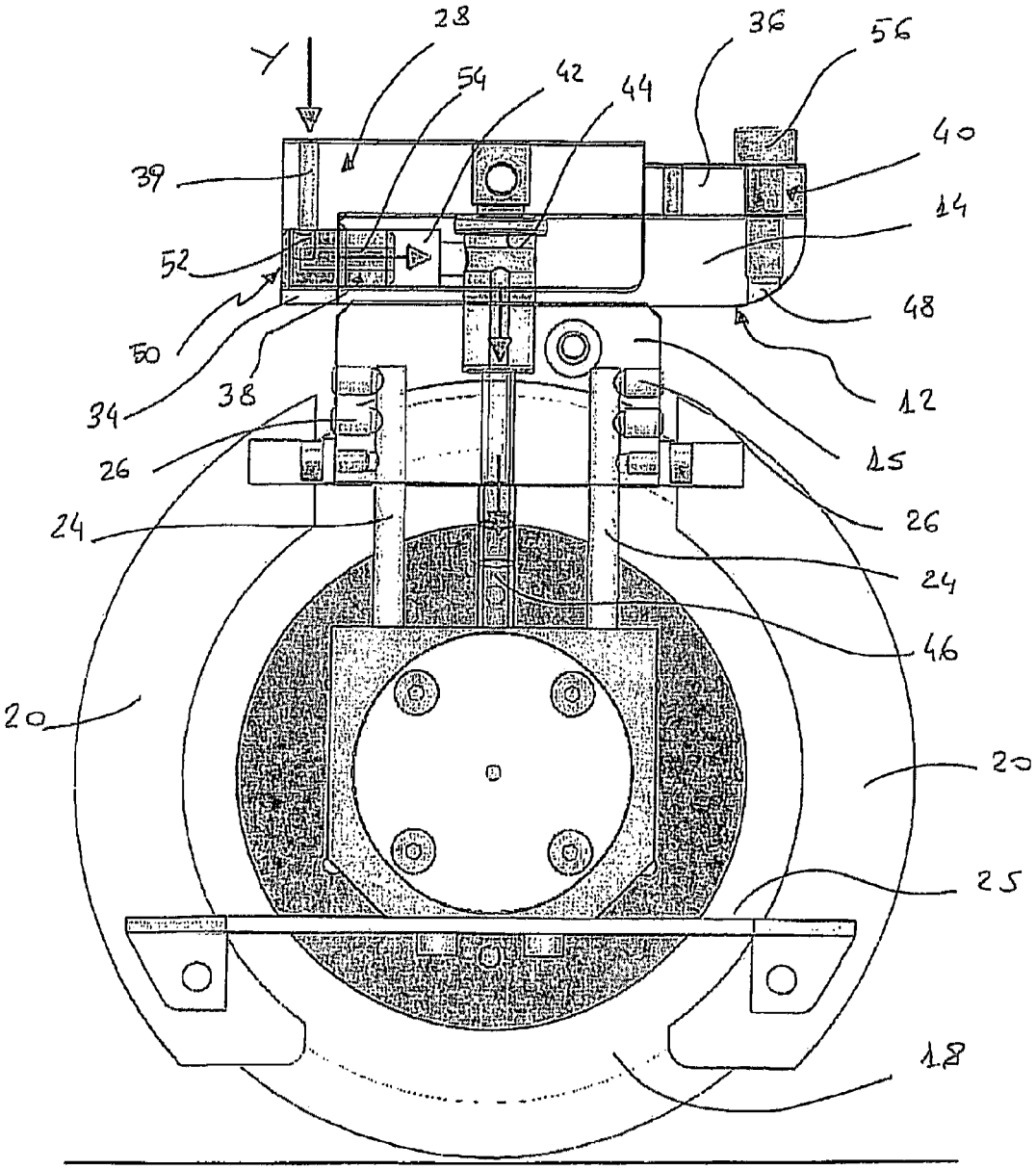

The construction and functional features of the tool change device for working apparatus of shearing machines of the present invention shall be better understood from the following detailed description, wherein reference is made to the annexed drawings showing a preferred and non-limiting embodiment thereof, and wherein:

FIG. 1 schematically shows an axonometric view of a working apparatus of shearing machines provided with the tool change device of the invention;

FIG. 2 schematically shows a partially exploded axonometric view of the working apparatus provided with the device of the invention;

FIG. 3 shows a partially sectioned schematic side view of the tool holder provided with the tool change device of the invention.

With reference to said figures, the tool change device for working apparatus 10 of sharing machines of the present invention, globally indicated with reference numeral 12 in the figures, comprises a block 14, on the lower front thereof is stabilized a tool or blade holder head 16 defined by a support 15 whereon is stabilized a protection casing 20 partially covering a blade 18, preferably circular shaped.

The blade 18 is supported and actuated in rotation through the friction action exerted by a counter-blade 22 located underneath the blade and operated by an electric motor (not shown in figure).

The blade 18 is stabilized to the support 15 through bars 24, partially sliding in the support thereof so to adjust the vertical position of the blade 18 and locked with one or more dowels 26.

The block 14 is fastened with the upper front opposed to the connection front with the tool 10, to a tool holder 28 stabilized respect to the structure of a shearing machine (not shown in the figure).

Said tool holder, preferably on the opposed side respect to the side connecting to the block 14 and, consequently, with the blade holder 16, has adjustment elements 30 apt to allow a vertical adjustment or calibration of the same blade holder 16 and a connector 32, commonly of the adjustable type, for the connection with the feeding system of the compressed air required for the movement of the adjustment and control devices of the tool position and the shearing pressure on the counter-blade.

during the operative phase; said adjustment elements, said connector and the adjustment and control devices of the position of the tool or blade 18, not being object of the present invention, shall not be discussed and described in detail.

The blade holder 28, on the lower bottom surface connecting with the block 14, has an appendix 34 partially developed in vertical direction starting from an end of said lower bottom surface and a further appendix 36 developing partially and according to a horizontal direction starting from the end opposite the one wherefrom the appendix 34 develops.

The appendix 34 and the further appendix 36 have a through hole 38 and a further through hole 40, formed respectively according to a horizontal and vertical direction; said holes have the function to house the components described hereinafter. A channel 39 is formed in the tool holder 28 in vertical direction and with an end communicating with the hole 38 of the appendix 34.

In the block 14, in horizontal direction, is formed a duct 42 coaxial to the hole 38 of the appendix 34, said duct is connected with a connector 44 provided with a through axial hole and a cross hole reciprocally communicating and arranged inside the block 14, the connector 44 partially inserted in a further duct 46 formed in the support 15; a through hole 48 is formed in the block 14 coaxial to the further hole 40 of the further appendix 36 of the tool holder 28.

Inside the hole 38 of the tool holder 28 is inserted a pin 50 or an equivalent mean having similar function, internally provided with two channels reciprocally communicating and orthogonal, a first passage 52 thereof is connected to the channel 39 of the tool holder 28 and a second passage 54 is connected with the duct 42 of the block 14.

A screw or pivot 56 or equivalent retention mean is inserted in the hole 48 of the block 14 and in the further hole 40 of the further appendix 26 of the tool holder 28.

The operation of the tool change device of the present invention, described in detail hereinabove with reference to its structural features, is described hereinafter.

With particular reference to FIGS. 1 and 2, is schematised the tool 16 respectively coupled and detached from the tool holder 28.

The operator, in order to mount a new tool 16 on the tool holder 28, makes the block 14 shift respect to the tool holder 28, as indicated by the arrow "X", inserts the pin 50 in the duct 42 and abuts the block 14 thereof against the appendix 34 of the tool holder 28. Finally, inserting the screw or pivot 56 in the further hole 40 of the further appendix 36 and in the hole 48 of the block 14, the locking and mechanical centring of the tool respect to the tool holder is achieved.

With regards to the passage of the compressed air required for the control of the blade or tool, the operator does not have to connect any pipe; in fact, the airflow, coming from a feeding pipe connected to the connector 32 through the channel 39, follows the pin 50 flowing through the first passage 52 and the second passage 54 and from here passes in the duct 42 of the block 14, crosses the further connector 44 to flow in the further duct 46 as indicated by the arrow "Y" in FIG. 3. In this way, the compressed airflow arrives directly to the tool without the need to connect again the pipes to connectors or valves.

As can be noticed from the above, the advantages achieved by the device of the invention are clear.

The tool change device for working apparatus of sharing machines of the present invention, advantageously allows to achieve a quick as well as easy replacement of tools, without the need to perform complex operations; said operation, moreover, is not affected by positioning and centring errors and, therefore, ensures optimal shearing quality over time.

A further advantage is that the restoring of the compressed air flow is performed without the connection, or detachment, of feeding pipes to connectors or similar, but directly by attaching the tool on the tool holder, thanks to the fact that the flow of compressed air flows inside the tool holder and the blade holder and not through external components or elements; the optimal coupling and centring ensured by the device of the invention contributes to the correct flowing of the compressed air without obstacles on the path thereof.

A further advantage is that the simplicity of execution of the tool change and the restoring of the compressed air flow, allows to perform the tool change in short time with consequent cost reduction and improvement of the production and work cycle times.

Even if the invention has been described hereinbefore with particular reference to an embodiment thereof made by way of a non-limiting example only, several changes and variations will appear clearly to a man skilled in the art in the light of the above description. This invention therefore is intended to include any changes and variations thereof falling within the spirit and the scope of the following claims.

The invention claimed is:

1. A tool change device (12) for a working apparatus (10) of longitudinal shearing machines adapted for working on paper, cardboard, plastic films, various coupled materials, aluminum, fabric, non woven, glass fiber, carbon fiber and similar materials, said tool change device comprising:

a tool holder (28) having a direct and quick compressed air feed;

a tool or blade holder head (16); and a block (14) stabilized on a lower front surface thereof to said tool or blade holder head (16) and coupled on an upper front surface thereof by a coupling device to a lower front surface of said tool holder (28) for quick coupling/centering and extraction with translatory movement between said block (14) and said tool holder (28), wherein said coupling device includes a first appendix (34) extending vertically downwardly from a first end of said lower front surface of said tool holder (28) providing an abutment for said block (14) and having a horizontally directed through hole (38) for acceptance of a pin (50) adapted to be coupled to said block (14), and a second appendix (36) extending horizontally from a second end of said lower front surface of said tool holder (28) opposing said first end of said lower front surface of said tool holder (28) having a vertically directed through hole (40) for acceptance of a screw or pivot (56) adapted to be coupled to said block (14).

2. The tool change device according to claim 1, wherein the block (14) at the bottom is stiffly constrained with respect to a support (15) of the tool or blade holder head (16) whereto is stabilized a protection casing (20) partially covering a first blade (18) actuated in rotation through friction action exerted by a counter-blade (22) operated by an electric motor, said first blade is stabilized to the support (15) through bars (24) and to the protection casing (20) by a plate (25).

3. The tool change device according to claim 1, wherein the block (14) at the abutment thereof with said first appendix (34) includes a duct (42) coaxial with said horizontally directed through hole (38) in said first appendix (34), said duct (42) being adapted to accept therein said pin (50) extending from said horizontally directed through hole (38) so as to couple said block (14) to said first appendix (34) extending from said tool holder (28).

4. The tool change device according to claim 3, wherein the block (14) includes a through hole (48) coaxial with said vertically directed through hole (40) in said second appendix (36) extending from said tool holder (28), said through hole (48) in the block (14) being adapted to accept therein said screw or pivot (56) extending from said vertically directed through hole (40) so as to couple said block (14) to said second appendix (36) extending from said tool holder (28).

5. The tool change device according to claim 4, wherein said pin (50) includes a first channel or passage (52) and a second channel or passage (54) reciprocally communicating and orthogonal one to the other, said first passage (52) communicating with a channel (39) formed in said tool holder (28) and communicating with the compressed air feed of said tool holder, and said second passage (54) communicating with the duct (42) in said block (14).

6. The tool change device according to claim 5, which further includes a connector (44) arranged within said block (14) and extending perpendicularly therefrom, said connector (44) having a through axial hole and a cross hole reciprocally communicating, said connector (44) being partially inserted in a duct (46) formed in a support (15) of the tool or blade holder head (16), said cross hole in said connector (44) communicating with the duct (42) in said block (14) and the axial hole in said connector (44) communicating with said duct (46) in said support (15).

* * * * *